US005637020A

United States Patent [19]

Ito

[11] Patent Number: 5,637,020

[45] Date of Patent: Jun. 10, 1997

[54] SOCKET FOR ELECTRICAL ELEMENTS

[75] Inventor: Katsuya Ito, Yokkaichi, Japan

[73] Assignee: Sumitomo Wiring Systems, Ltd., Japan

[21] Appl. No.: 389,358

[22] Filed: Feb. 16, 1995

[30] Foreign Application Priority Data

Feb. 17, 1994 [JP] Japan ..... 6-044917

[51] Int. Cl.[6] ..... H01R 17/00

[52] U.S. Cl. ..... 439/699.2; 439/854; 439/890

[58] Field of Search ..... 439/854, 855, 439/851, 79, 842, 843, 856, 858, 852, 853, 890, 699.2

[56] References Cited

U.S. PATENT DOCUMENTS 3,999,095 12/1976 Pearce et al. .
4,186,987 2/1980 Pearce, Jr. et al. ..... 439/855
4,804,343 2/1989 Reedy ..... 439/854
5,399,103 3/1995 Kuboshima et al. ..... 439/855

FOREIGN PATENT DOCUMENTS 1-86085 6/1989 Japan .
3017429 4/1991 Japan .
1280881 7/1972 United Kingdom .

*Primary Examiner*—David L. Pirlot
*Attorney, Agent, or Firm*—Jordan B. Bierman; Bierman, Muserlian and Lucas LLP

[57] ABSTRACT

A connector terminal having a relay terminal in the form of a flat plate is inserted through an opening in a connector receptacle. Thereafter, an element terminal having a relay terminal in the form of a flat plate is inserted through an opening in an element receptacle. As a result of the inserting operations, the relay terminal is fitted into an engaging hole formed in the relay terminal in the connector receptacle, thereby establishing a secure electrical connection between the terminals.

5 Claims, 9 Drawing Sheets

SOCKET FOR ELECTRICAL ELEMENTS

This Application claims the priority of Japanese Application 6-44917, filed Feb. 17, 1994.

The present Invention relates to a connector socket, particularly, an L-shaped bulb socket including a bulb receptacle and a connector receptacle.

BACKGROUND OF THE INVENTION

Sockets of the general type claimed herein are disclosed in Japanese Unexamined Utility Model Publication 1-86085. As shown in FIG. 13, bulb socket 1 has main body 2 formed with bulb receptacle 3 on which bulb 7 and connector receptacle 4 are mounted. The electric power is supplied through feeder connector 8. Bulb receptacle 3 and connector receptacle 4 are arranged so that main body 2 has a substantially L-shaped form. Bulb terminal 5 and connector terminal 6 are electrically connectable with bulb 7 and a feeder connector 8, respectively, and are inserted and assembled in main body 2.

As shown in FIG. 14, connector terminal 6 includes a connector tab 6*a* which is in the form of a long narrow plate member engageable with feeder connector 8, and a holder 6*b* electrically connectable with bulb terminal 5. Connector terminal 6 is mounted in main body 2 by inserting connector tab 6*a* through insertion hole 10 from recess 9 formed in the outer surface of main body 2, so that the leading part of connector tab 6*a* projects into connector receptacle 4 and holder 6*b* is disposed in recess 9.

Bulb terminal 5 includes a pair of bulb holders 5*a* which are elastically deflected to come into contact with a base 7*a* of bulb 7 from opposite sides. Tongue 5*b* is provided below bulb holders 5*a* in the form of a long narrow plate member electrically connectable with connector terminal 6. Bulb terminal 5 is mounted in main body 2 by inserting tongue 5*b* from bulb receptacle 3 to recess 9 through insertion hole 11 and by holder 6*b* engaging tongue 5*b*.

After mounting terminals 5 and 6 in main body 2, recess 9 is filled by insulating sealant 12, thereby to cover tongue 5*b* and holder 6*b*. This prevents penetration of water from the outside of main body 2, thereby preventing corrosion and short-circuiting of terminals 5 and 6.

Further, Japanese Examined Utility Model Publication No. 3-14791 and Japanese unexamined Utility Model Publication No. 3-17429 disclose a bulb socket in which a bulb terminal and a connector terminal are integrally formed into a single L-shaped terminal which is mounted by insertion through connector receptacle or bulb receptacle.

However, in bulb socket 1 according to the prior art, there is a likelihood that sealant 12 in recess 9 enters into bulb receptacle 3 and connector receptacle 4 through clearances between the walls defining insertion holes 10 and 11, thereby depositing on the surface of bulb holder 5*a* and connector tab 6*a*. This causes contact failures between bulb 7 and feeder connector 8. Further, the fabrication of bulb socket 1 necessitates introducing sealant 12 in addition to mounting terminals 5 and 6; thus, a waiting period until sealant 12 is hardened is required.

Moreover, with the bulb socket of the prior art, to mount the L-shaped terminal, the connector receptacle or bulb receptacle from which the terminal is inserted is required to have a larger size and a complicated structure. Particularly, in the embodiment of Japanese 3-14791, the terminal cannot establish a secure electric connection with the bulb because the bulb holder has insufficient elasticity or spring force to insert the terminal through the connector receptacle.

SUMMARY OF THE INVENTION

It is an object of the present Invention to provide a bulb socket which is smaller in size and is capable of making a secure electrical contact.

According to the Invention, the bulb terminal and the connector terminal are inserted into their respective receptacles, preferably through the opening of the bulb receptacle and connector receptacle, for easy mounting in the socket main body. This also prevents contact failures, which occur between the bulb terminal and the bulb and between the connector terminal and the feeder connector, resulting from the use of the sealant necessary in the prior art. Further, since it is not necessary to introduce the sealing agent, the bulb socket can be fabricated more easily.

In a preferred embodiment of the Invention, the bulb terminal is inserted through the opening of the bulb receptacle, and the connector terminal is inserted through the opening of the connector receptacle. Thus, it is not necessary to form an opening on the outer surface of the socket main body for inserting the terminals. This obviates the need for introducing the sealant into the opening for inserting the terminals, which is necessary when the terminals are inserted through the outer surface of the socket main body.

In another embodiment of the Invention, the terminal having the engaging hole is inserted first and followed by the other terminal. In the fully mounted state, the second inserted terminal is fitted into the engaging hole on the first inserted terminal, thereby establishing an electrical connection therebetween both terminals.

According to a further embodiment of the Invention, the electrical contact between the inserting ends of the bulb and connector terminals is established by fitting the inserting end of one terminal in the engaging hole formed in the inserting end of the other terminal. Thus, the shape of the inserting ends can be simplified, thereby facilitating the fabrication of the bulb terminal and the connector terminal.

According to a still further embodiment of the Invention, the inserting ends of the both terminals are in contact while at least one of the inserting ends is elastically deflected; thus, the electrical contact can be established more securely. It should be appreciated that the term "inserting end" used in the claims refers to the part of the terminals which is to be introduced first into the corresponding receptacle.

BRIEF DESCRIPTION OF THE DRAWINGS

In the accompanying drawings, constituting a part hereof, in which like reference characters indicate like parts.

DETAILED DESCRIPTION OF THE INVENTION

Figure 1:
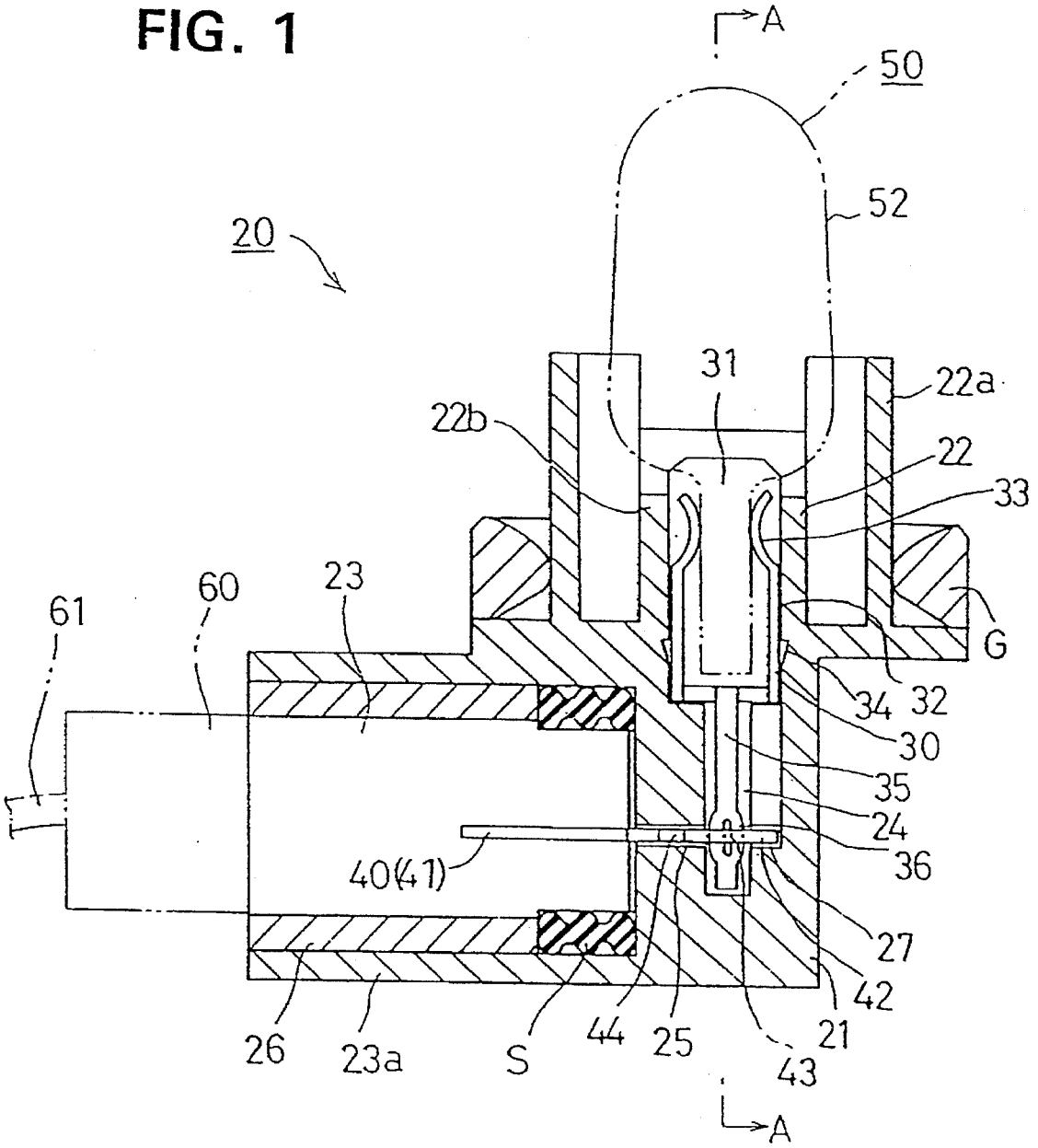
FIG. 1 is a section of the first embodiment of the Invention.
Figure 2:
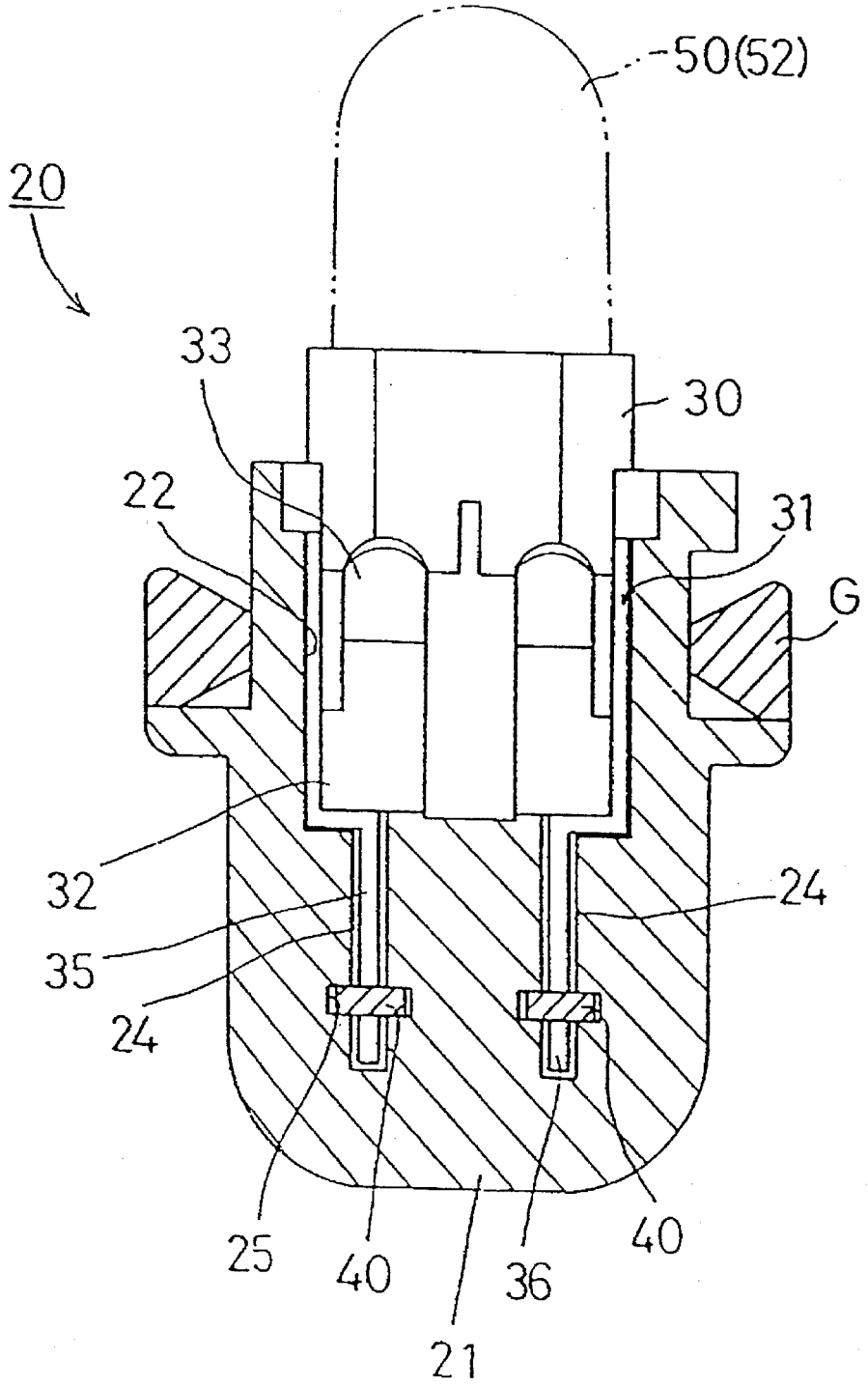
FIG. 2 is a section along line A—A of FIG. 1.

With reference to FIGS. 1 to 3 and 12, bulb socket 20 includes socket main body 21 of insulating synthetic resin which comprises bulb terminal 30 of conductive metal and connector terminal 40.

Socket main body 21 is, as a whole, L-shaped and is formed with bulb receptacle 22 in the form of a hood, in which bulb 50 is mounted, and a connector receptacle 23, in which feeder connector 60 is mounted. Bulb and connector receptacles 22 and 23 are open in directions normal to each other. Gasket G of elastic rubber is mounted on the outer circumferential surface of cylindrical outer wall 22*a* of bulb receptacle 22; outer wall 22*a* defines a circle in its horizontal cross-section, so that bulb socket 20 can be mounted in a watertight manner in a mount hole of an unillustrated lamp housing. Inside outer wall 22*a* is inner wall 22*b* in which bulb terminal 30 is mounted. Inner wall 22*b* has a closed bottom and substantially defines a rectangle in its horizontal cross-section. Outer and inner wall portions 22*a* and 22*b* are concentrically formed. In the bottom surface of inner wall 22*b* is a pair of bulb terminal insertion holes 24 into which the leading ends of bulb terminals 30 are inserted.

In connector receptacle 23, seal ring S of elastic rubber is fitted at the bottom of hood 23*a* having a closed bottom and a circular vertical cross-section. Hollow cylindrical ring holder 26 for holding seal ring S is mounted in hood 23*a* and retained by engagement with an unillustrated engaging projection. Feeder connector 60 fits in ring holder 26. In the bottom surface of hood 23*a* is a pair of connector terminal insertion holes 25 in which the leading ends of connector terminal 40 are insertable. The leading ends of insertion holes 25 cross insertion holes 24 at right angles and communicate with each other. In FIG. 1, receiving face 27 supports the leading end of inserted connector terminal 40 and is in each insertion hole 24.

Figure 3:
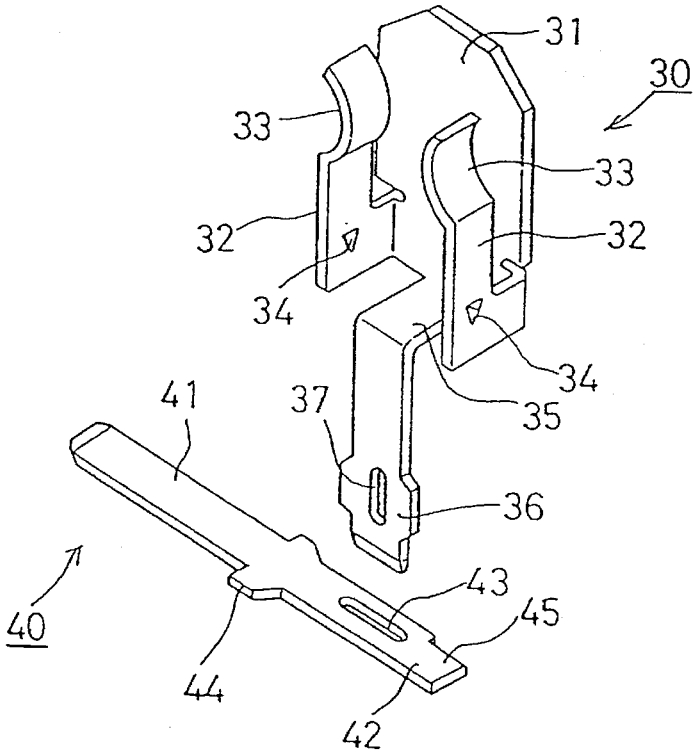
FIG. 3 is a perspective view of a bulb terminal and a connector terminal.

Bulb terminal 30 in bulb receptacle 22 is, as shown in FIG. 3, formed by bending a conductive metal plate cut by means of a press. Bulb terminal 30 has side wall 31 along one longitudinal surface of inner wall 22*b* and a pair of support plates 32, along the side surfaces of inner wall 22*b*. Support plates 32 are formed by bending opposite bottom side portions of the cut metal plate at right angles in the same direction. Bulb terminal 30 fits substantially in inner wall 22*b*. Inwardly curving bulb contacts 33 are formed at leading ends of opposite support plates 32 to tightly hold inserted bulb 50. The surface of each support plate 32 is triangularly cut and bent outward and upright to form locking projection 34. Locking projections 34 cut into the inner surface of inner wall 22*b* to hold bulb terminal 30 in inner wall 22*b*. The base end of bulb terminal 30 is bent inward at right angles with respect to side wall 31 at the bottom end thereof and further bent downward at right angles to form L-shaped relay connecting portion 35. At the leading end of connecting portion 35 is relay terminal 36 which is relatively flat and wide. Hole 37 is formed in relay terminal 36, which makes the parts of relay terminal 36 at opposite sides of hold 37 narrower to permit elastic deflection of relay terminal 36 in the lateral direction.

Connector terminal 40 is in the form of a flat plate having a substantially constant width. One end of connector terminal 40 is connector tab 41 engageable with an unillustrated female terminal mounted in feeder connector 60, and the other end thereof is relay terminal 42. In relay terminal 42, there is formed an engaging hole 43 which is slightly shorter than the width of relay terminal 36 of bulb terminal 30. Between connector tab 41 and relay terminal 42 are formed a pair of winglike locking projections 44 which project outward from the opposite lateral edges of connector terminal 40. The width of connector terminal 40 where locking projections 44 are formed is slightly greater than the width of connector terminal insertion hole 25. Each locking projection 44 is in the form of a wedge, tapered toward relay terminal 42. Locking projections 44 are pressed into insertion hole 25 to retain connector terminal 40. At the leading end of relay terminal 42 is formed a stepped narrow portion 45 which rests on receiving face 27 in bulb terminal insertion hole 24.

Figure 12:
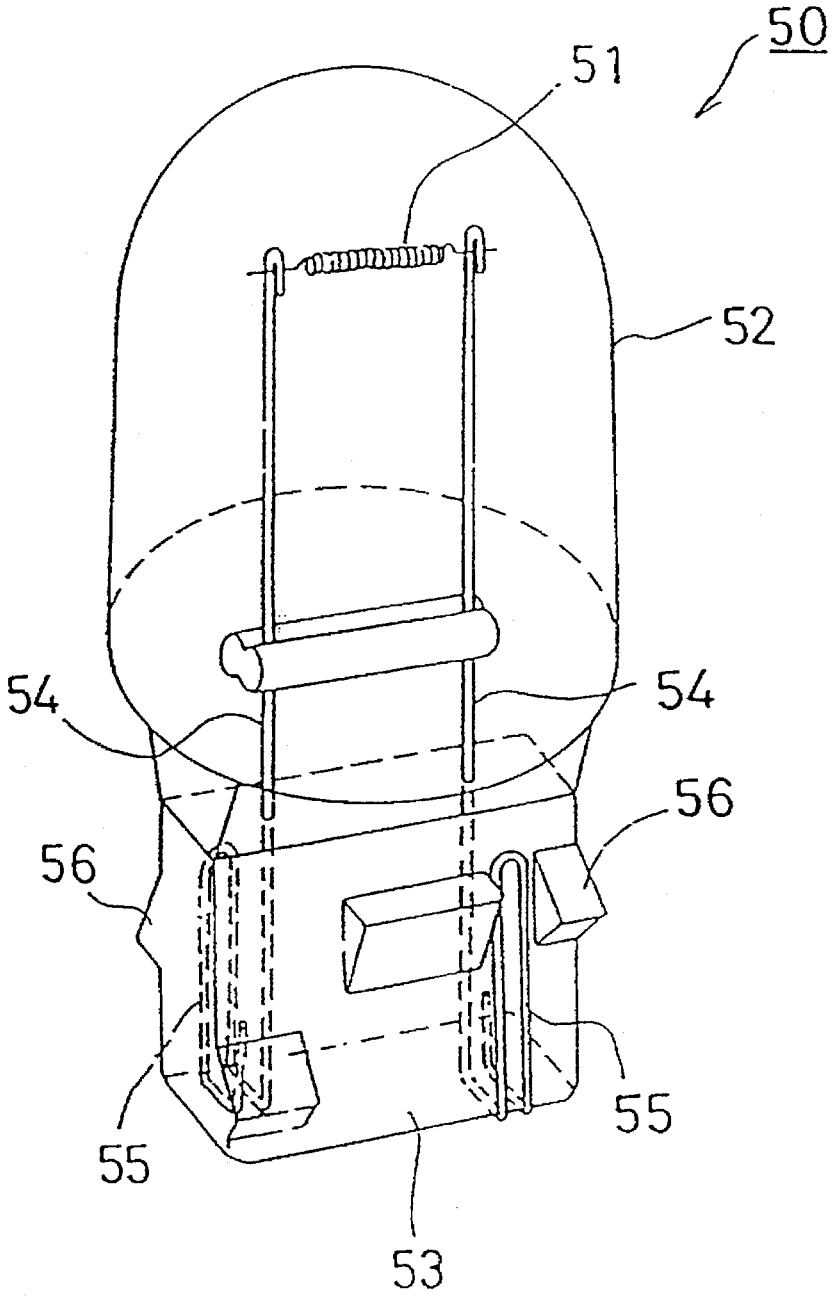
FIG. 12 is a perspective view of a wedge-base bulb.
Figure 13:
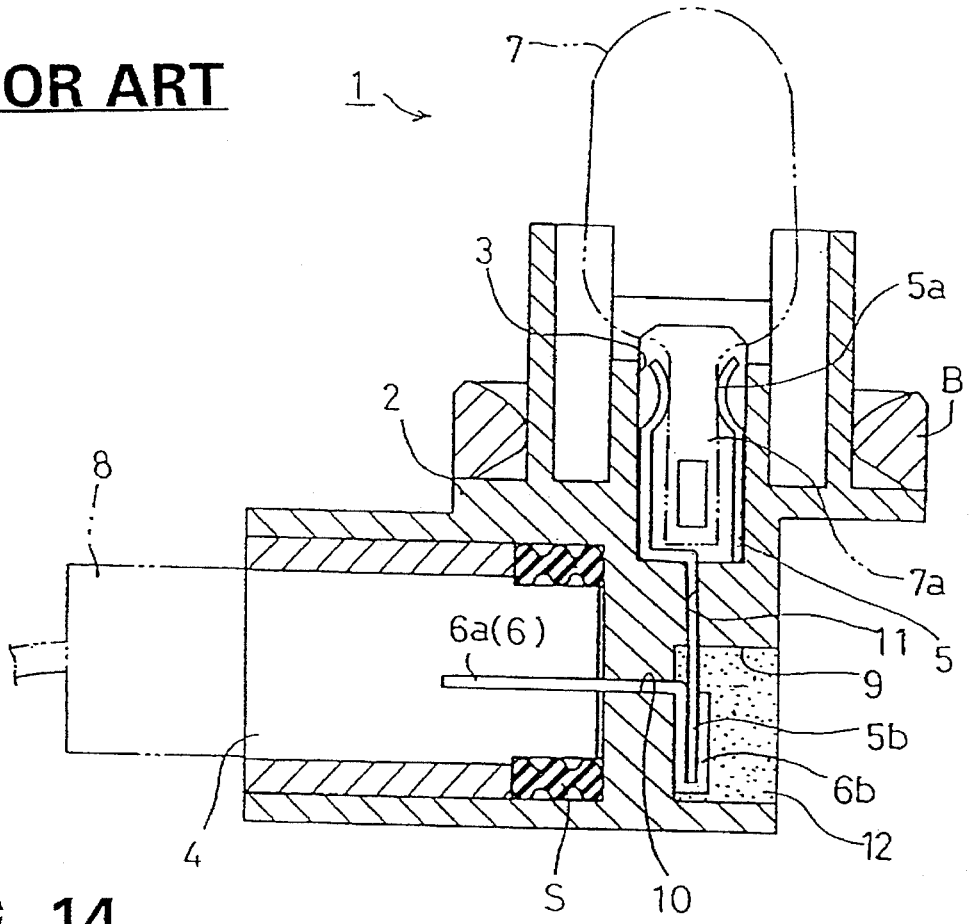
FIG. 13 PRIOR ART
FIG. 13 is a section of a prior art bulb socket.
Figure 14:
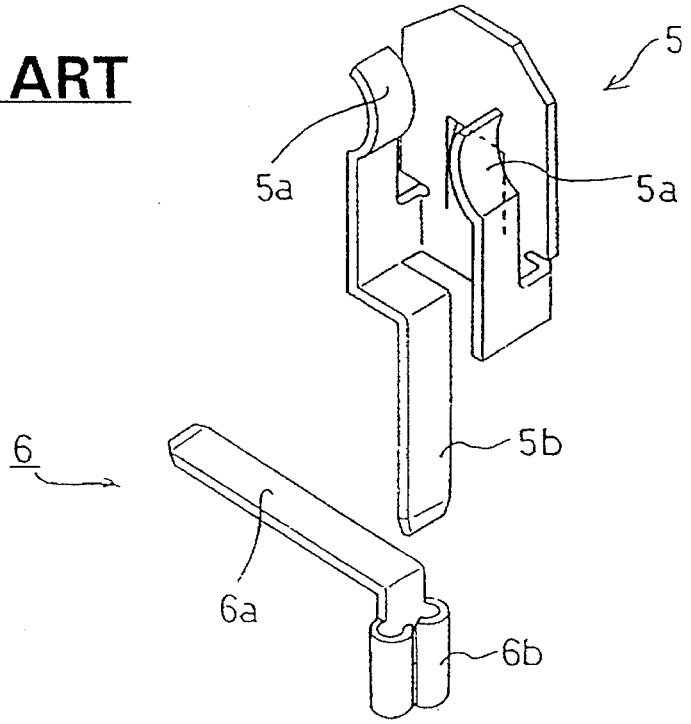
FIG. 14 PRIOR ART
FIG. 14 is a perspective view of a bulb terminal and a connector terminal according to the prior art.

As shown in FIG. 12, bulb 50 mounted in bulb receptacle 22 has a known structure of the single filament type. Specifically, bulb 50 includes bulb body 52 for containing filament 51 and flat rectangular base 53 of glass which is formed integrally with bulb body 52 at the bottom thereof. Two lead wires 54 extending from the bottom of base portion 53 are turned along the opposite side surfaces of base portion 53, thereby forming feeder terminals 55. Further, locking projection 56 is formed on each side surface of base 53 to prevent base 53 from coming out of inner wall 22*b*. Being mounted in inner wall 22*b*, base 53 is tightly held by the elastic force generated by bulb holders 33 of bulb terminal 30; bulb holders 33 and feeder terminals 55 come into contact, thereby electrically connecting base portion 53 with bulb terminal 30.

Feeder connector 60, mounted in connector receptacle 23, is provided with an unillustrated feeder terminal at its leading end and lead wire 61 extending from its rear end, lead wire 61 being connected with an unillustrated battery. Being mounted in connector receptacle 23, the feeder terminal of feeder connector 60 is electrically connected with connector terminal 40.

In operation, bulb terminal 30 and connector terminal 40 are assembled in socket main body 21. Connector terminal 40 is first mounted in connector receptacle 23. Specifically, relay terminal 42 of connector terminal 40 is inserted first into connector receptacle 23 until the leading end of relay terminal 42 is in connector terminal insertion hole 25 and narrow portion 45 reaches receiving face 27. During this insertion, locking projections 44 are pressed into insertion hole 25, with the result that locking projections 44 cut into the inner wall of insertion hole 25 thereby to lockingly hold connector terminal 40. In this state, engaging hole 43 is located in the part of insertion hole 25 communicating with bulb terminal insertion hole 24.

Subsequently, bulb terminal 30 is mounted in bulb receptacle 22. Relay connecting portion 35 of bulb terminal 30 is inserted first into bulb receptacle 22, thereby inserting relay connecting portion 35 into bulb terminal insertion hole 24. Relay connecting portion 35 is inserted until its base end reaches the bottom face of bulb receptacle 22 while side wall 31 and support plates 32 slide in contact with and along the inner side surfaces of inner wall 22*b*. Locking projections 34 cut into the inner side surfaces of inner wall portion 22*b*, to lock bulb terminal 30 in place. Relay terminal 36 is pressed into engaging hole 43 while being elastically deflected as permitted by the presence of hole 37, thereby securely contacting the wall defining engaging hole 43. Since narrow portion 45 of relay terminal 42 is supported on receiving face 27, relay terminal 36 fits in engaging hole 43 without bending relay terminal 42. In this way, both terminals 30 and 40 are mounted in socket main body 21.

Bulb terminal 30 is inserted through bulb receptacle 22 and connector terminal 40 is inserted through connector receptacle 23. Accordingly, terminals 30 and 40 can be mounted without having openings in the outer surface of socket main body 21 for that purpose. Since penetration of water is prevented by seal ring S when feeder connector 60 is fitted in hood portion 23*a*, seal ring S cooperates with gasket G to achieve a waterproof bulb socket.

The connection of bulb terminal 30 and connector terminal 40 is accomplished by the elastic contact of relay terminal 36 with the internal walls of engaging hole 43 in connector terminal 40. Despite the simple structure of the connecting portion of terminals 30 and 40, a secure electrical connection can be established.

Engaging hole 43 is formed in connector terminal 40 and relay terminal 36 of bulb terminal 30 fits therein. Conversely, the engaging hole may be formed in the bulb terminal and the connector terminal fitted therein.

Figure 4:
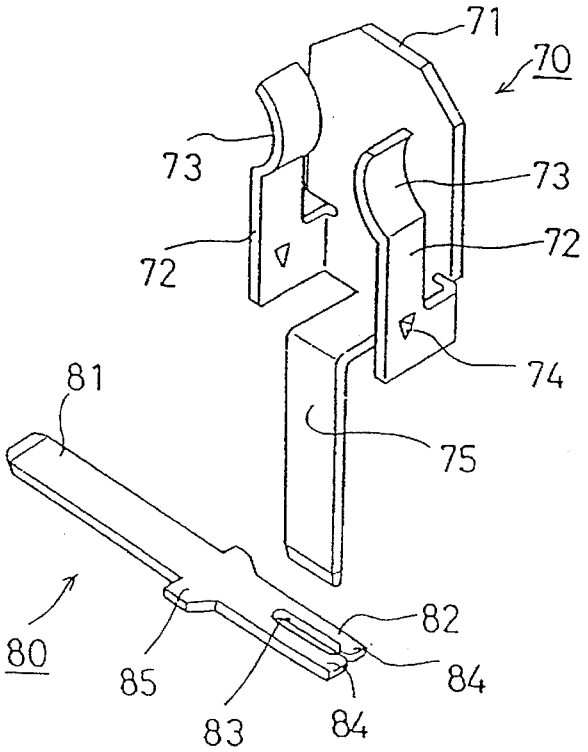
FIG. 4 is a perspective view of a bulb terminal and a connector terminal of a second embodiment of the Invention.

With reference to FIG. 4, a second embodiment of the Invention comprises bulb terminal 70 which has a structure similar to bulb terminal 30. Side wall 71, support plates 72, 72 extending from opposite side ends of the side wall 71, bulb holders 73, locking projections 74, and a narrow, long and L-shaped relay connecting portion 75 extending from the bottom end of side wall 71, are provided. The leading end of relay connecting portion 75 is in the form of a long and narrow plate having a constant width over its length.

Connecting terminal 80 is, as a whole, in the form of a long narrow plate also having a substantially constant width. At relay terminal 82, opposite connector tab 81, is engaging slot 83 which is oblong in the lengthwise direction of connector terminal 80 and open at the leading edge of relay terminal 82. At the open inner edges of engaging slot 83 are formed a pair of engaging projections 84, opposed to each other. The clearance between engaging projections 84 is slightly smaller than the thickness of relay connecting portion 75. Similar to the first embodiment, a pair of winglike locking projections 85 project outward from opposite lateral edges of connector terminal 80 between connector tab 81 and relay terminal 82.

Terminals 70 and 80 are mounted in the socket main body (not shown in FIG. 4) as follows. After connector terminal 80 is inserted into the connector terminal insertion hole, bulb terminal 70 is inserted into the bulb terminal insertion hole. The leading end of engaging slot 83 is opened during the insertion of bulb terminal 70. Since the leading end of engaging slot 83 is elastically deflectable, engaging projections 84 are spaced wider apart by inserted relay connecting portion 75 and come into contact with relay connecting portion 75 due to the elastic force, thereby establishing a secure electrical connection.

Figure 5:
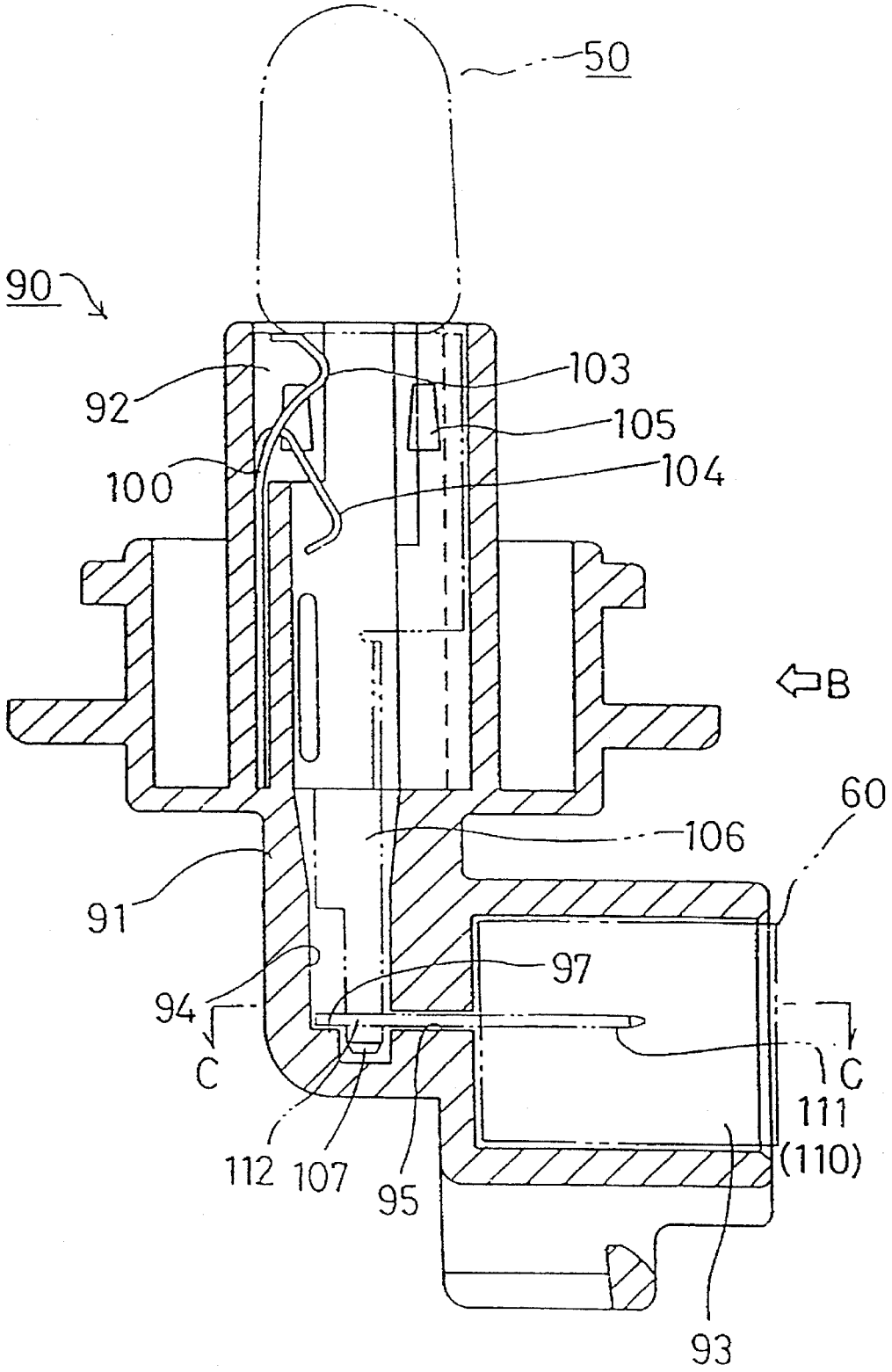
FIG. 5 is a section similar to that of FIG. 1 of a further embodiment of the Invention.
Figure 6:
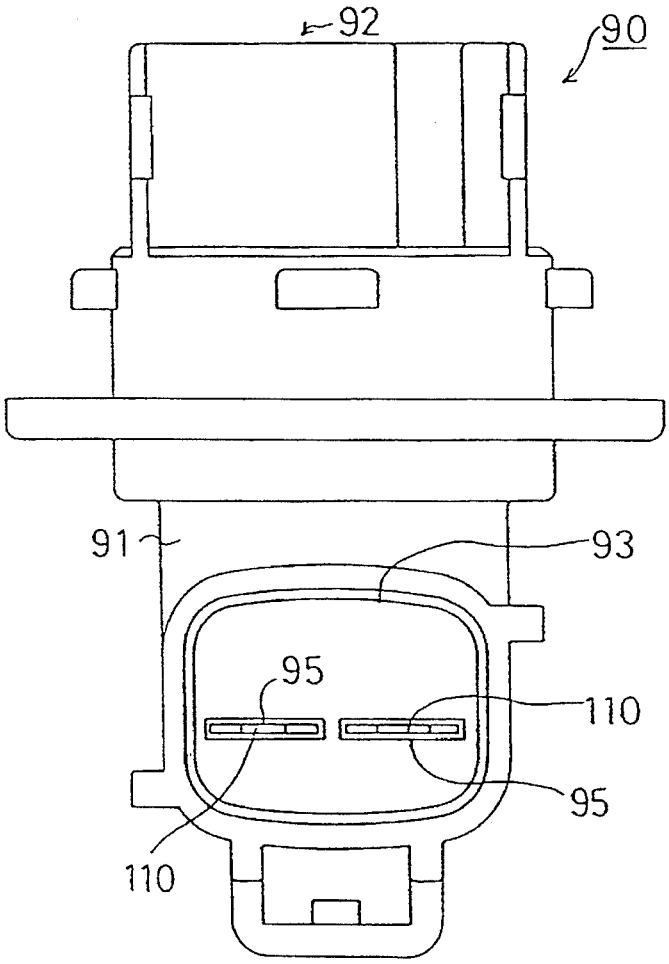
FIG. 6 is a view from the direction of arrow B of FIG. 5.
Figure 7:
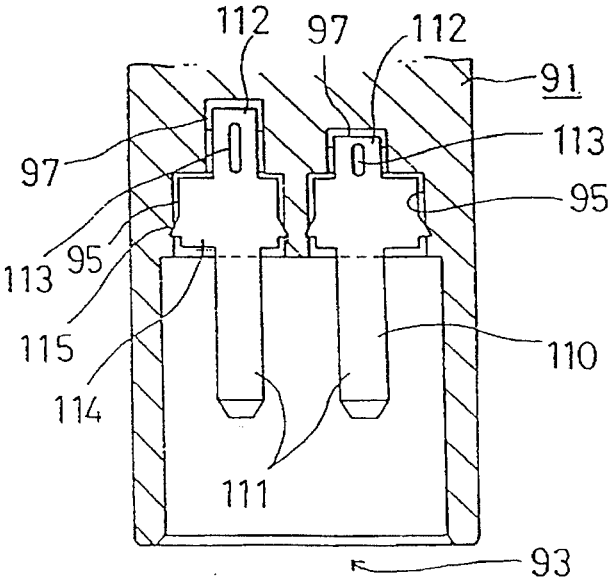
FIG. 7 is a section along line C—C of FIG. 5.

A third embodiment of the Invention is shown in FIGS. 5 to 11. As shown in FIG. 5, socket main body 91 is generally L-shaped and is provided with bulb receptacle 92 in the form of a hood, in which bulb 50 (FIG. 12) is mounted, and connector receptacle 93, in which feeder connector 60 is mounted. Bulb and connector receptacles 92 and 93 are open in directions normal to each other. At the bottom surface of connector receptacle 93 is a pair of connector terminal insertion holes 95 which communicate with corresponding bulb terminal insertion holes 94. As shown in FIG. 7, each insertion hole 95 has a width such that corresponding locking projections 115 of connector terminal 110 are pressed against the wall defining insertion hole 95. In each bulb terminal insertion hole 94, in communication with corresponding connector terminal insertion hole 95, is formed receiving face 97 for supporting the leading end of inserted connector terminal 110. When connector terminal 110 is pressed into insertion hole 95, its end is supported on receiving face 97 and is held therein by locking projections 115.

Figure 8:
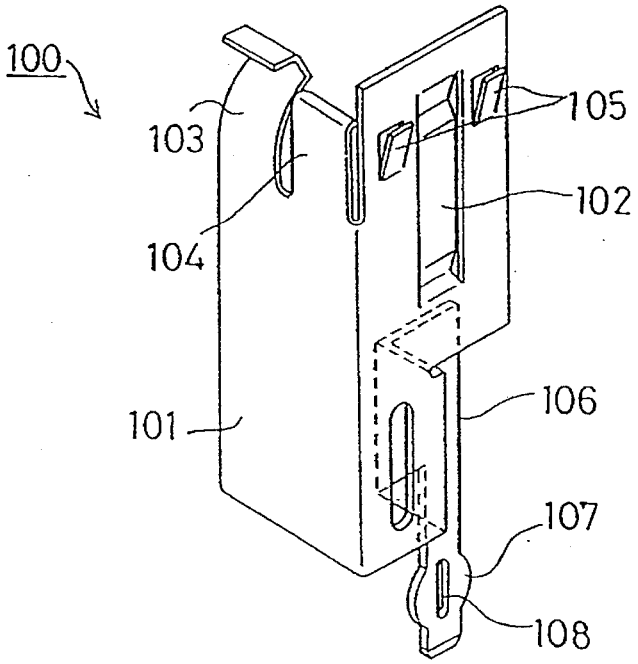
FIG. 8 is a perspective view of a bulb terminal.
Figure 9:
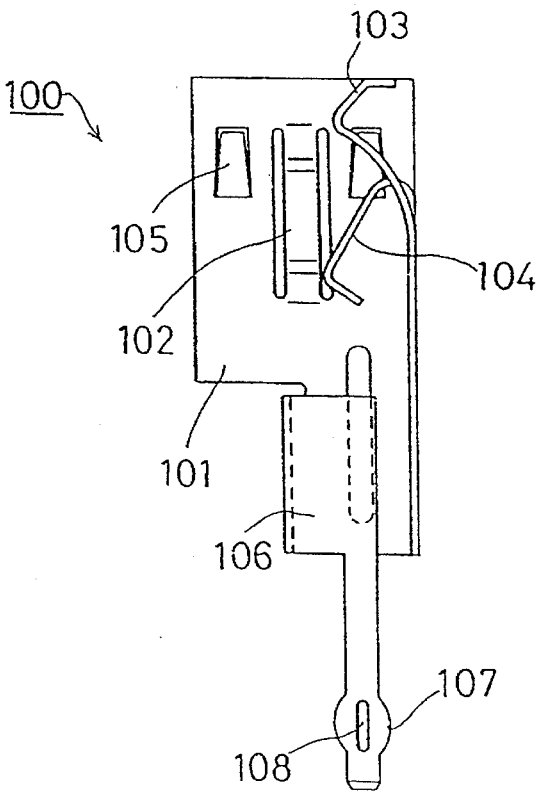
FIG. 9 is a front view of the bulb terminal of FIG. 8.

As shown in FIGS. 8 and 9, bulb terminal 100 mounted in bulb receptacle 92 includes, at its upper part, bulb contact portion 101 which is bent into an L-shaped form when viewed from the above. Bulb contact 101 mechanically holds base 53 of bulb 50 and electrically contacts feeder terminals 55 thereof. More specifically, contact 101 is formed with elastic pressing member 102 for pressing against the opposite longitudinal surfaces of base 53 and elastic holding member 103 for pressing the opposite side surfaces of base 53. Pressing member 102 is formed by cutting the face of contact 101 along two substantially parallel lines and bending the portion between these two lines inward. Holding member 103 is formed by bending. Below holding member 103, is feeder electrode 104 which is bent to face downward. Feeder electrode 104 is in contact with feeder terminal 55 when base 53 is held by contact 101. At opposite sides of pressing member 102 are a pair of locking projections 105 which are formed by cutting the face of contact portion 101 along two lateral sides and an upper side and bending this cut part to open outward and upward. Locking projections 105 are cut in the inner wall of bulb receptacle 92 to lock bulb terminal 100 in bulb receptacle 92.

At the bottom end of bulb terminal 100 is formed long narrow relay connecting portion 106 which extends downward. At the leading end of connecting portion 106 is wide relay terminal 107 having hole 108. Hole 108 permits elastic deflection of connecting portion 107 in the widthwise direction.

Figure 10:
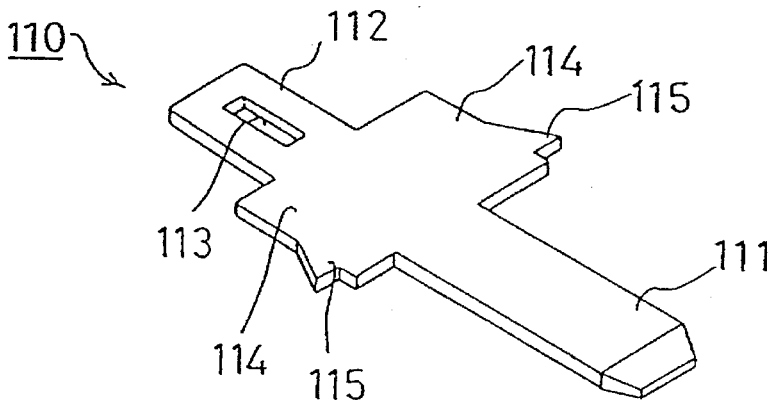
FIG. 10 is a perspective view of a connector terminal.
Figure 11:
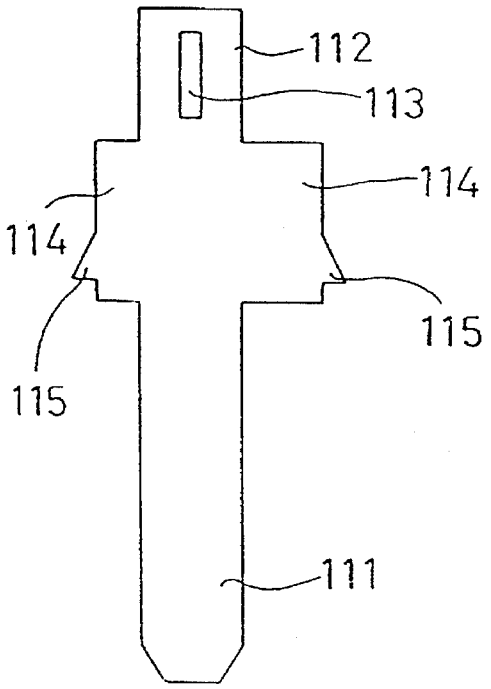
FIG. 11 is a plan view of the connector terminal of FIG. 10.

As shown in FIGS. 10 and 11, connector terminal 110 is generally in the form of a long and narrow plate having a constant width. One end of connector terminal 110 is connector tab 111 engageable with an unillustrated female terminal and the other end thereof is relay terminal 112. Relay terminal 112 has engaging hole 113 which is slightly shorter than the width of relay terminal 107 of bulb terminal 100. A pair of winglike pressing projections 114 project outward from the opposite lateral edges of connector terminal 110 between connector tab 111 and relay terminal 112. Locking projections 115 are formed at the outer end of pressing projections 114. Each locking projection 115 is in the form of a wedge tapered toward relay terminal 112 and its lengthwise end facing connector tab 111 is cut away at right angles with respect to the lateral side edge of connector terminal 110.

To mount bulb terminal 100 and connector terminal 110 in socket main body 91, connector terminal 110 is first inserted into connector receptacle 93 with relay terminal 112 leading, thus pressing relay terminal 112 into connector terminal insertion hole 95. Locking projections 115 of pressing projections 114 cut into the inner wall of insertion hole 95 to lockingly hold connector terminal 110 therein. Consequently, engaging hole 113 is located in a part of insertion hole 95 communicating with bulb terminal insertion hole 94.

Subsequently, relay connecting portion 106 of bulb terminal 100 is inserted first into bulb receptacle 92, whereby connecting portion 106 enters into bulb terminal insertion hole 94. Locking projections 105 of bulb terminal 100 are elastically deflected to come into contact with the inner wall of bulb receptacle 92, whereby bulb terminal 100 is locked therein. Relay terminal 107 at its leading end is inserted into engaging hole 113 of connector terminal 110. In this way, terminals 100 and 110 are mounted in socket main body 91.

In this condition, relay terminal 107 is securely in contact with engaging hole 113 while being elastically deflected in the widthwise direction because engaging hole 113 is slightly shorter than the width of relay terminal 107, and due to the presence of hole 108 which permits elastic deflection of the relay terminal in the widthwise direction.

Since no sealant is used in bulb socket 90, it is free from undesirable contact failures resulting from flow of the sealant along the surface of the terminals and deposition thereof at contact portions of the terminals. Since the connection between bulb terminal 100 and connector terminal 110 is accomplished simply by fitting bulb terminal 100 into engaging hole 113 in connector terminal 110, terminals 100 and 110 can be fabricated easily and inexpensively.

Relay portion 107 of bulb terminal 100 is fitted into engaging hole 113 formed in relay terminal 112 of connector terminal 110. However, the bulb terminal may be formed with the relay terminal having the engaging hole and the relay connecting portion of the connector terminal may be fitted therein.

Although only three embodiments of the Invention have been expressly described, such modifications as would suggest themselves to the person of ordinary skill may be made without departing from the scope or spirit thereof. For example, (1) Although, in the express embodiments, the Invention is applied to a bulb socket for holding a wedge-base bulb of single filament type, the Invention is applicable to bulb sockets for holding wedge-base bulbs double filament type and bulbs having a metal base, rather than a wedge-base.

(2) The connector terminal need not necessarily be provided with locking means, since the bulb terminal engaged therewith prevents it from coming out of the socket main body. Further, since both terminals are connected in directions normal to each other at their leading ends, the locking devices formed in the bulb and connector terminals can be replaced by devices provided in the connecting structure. This makes the mounting of the bulb and connector terminals easier.

The connector sockets may be used with bulbs, fuses, diodes, transistors, resistors, electronic chips, switches, and the like. Although the Invention has been described in connection with a limited number of embodiments, it is, nonetheless, to be broadly construed and not to be limited except by the character of the claims appended hereto.

I claim:

1. A connector socket comprising a main body having an element receptacle and a connector receptacle, said element receptacle having an element axis and said connector receptacle having a connector axis, said element axis and said connector axis forming an angle therebetween which is greater than 0° and less than 180°, an element terminal in said element receptacle and a connector terminal in said connector receptacle, said element terminal and said connector terminal in contact with each other, whereby electrical contact is established between said element terminal and said connector terminal, said element terminal and said connector terminal each having a proximal end, adjacent which contact is made between said element terminal and said connector terminal, and a distal end, remote from said proximal end, one said proximal end having an engaging hole therethrough and another said proximal end extending through said engaging hole in an insertion direction, and an end portion projecting from said engaging hole, a receiving face parallel to said insertion direction on said main body, said end portion resting on said face, whereby said element terminal and said connector terminal are locked in electrical contact.

2. The connector socket of claim 1 wherein the other said proximal end is inserted into said engaging hole in an insertion direction, the other said proximal end having a width greater than said engaging hole whereby the other said proximal end is elastically deflected in a deflection direction which is transverse to said insertion direction.

3. The connector socket of claim 1 wherein at least one of said element terminal and said connector terminal carries locking portions.

4. The connector socket of claim 1 wherein said element receptacle is adapted to receive a bulb, fuse, diode, transistor, resistor, electronic chip, or switch.

5. The connector of claim 1 wherein said engaging hole comprises a slot elongated in a transverse direction to an insertion direction of the other said proximal end, said slot being open at said proximal end.

* * * * *